US006761250B1

(12) United States Patent
Szentistvany et al.

(10) Patent No.: US 6,761,250 B1
(45) Date of Patent: Jul. 13, 2004

(54) TRACK FOR STAIRLIFTS

(75) Inventors: Andreas Csaba Szentistvany, Andover (GB); Martyn Harry Jenkins, Salisbury (GB)

(73) Assignee: Stannah Stairlifts Limited, Hampshire (GB)

( * ) Notice: Subject to any disclaimer, the term of this patent is extended or adjusted under 35 U.S.C. 154(b) by 0 days.

(21) Appl. No.: 09/806,809

(22) PCT Filed: Oct. 19, 1999

(86) PCT No.: PCT/GB99/03447

§ 371 (c)(1),
(2), (4) Date: May 17, 2001

(87) PCT Pub. No.: WO00/23371

PCT Pub. Date: Apr. 27, 2000

(30) Foreign Application Priority Data

Oct. 19, 1998 (GB) ..... 9822809

(51) Int. Cl.[7] ..... B66B 9/08
(52) U.S. Cl. ..... 187/201; 187/249
(58) Field of Search ..... 187/201, 202, 187/245, 406, 408

(56) References Cited

U.S. PATENT DOCUMENTS 3,014,556 A 12/1961 Stelzer
3,891,062 A * 6/1975 Geneste ..... 187/245
3,966,022 A * 6/1976 Cheney ..... 187/201
4,534,451 A * 8/1985 Peter ..... 187/408 X
5,066,834 A 11/1991 Richter
5,709,154 A * 1/1998 Schott ..... 187/201 X

FOREIGN PATENT DOCUMENTS

DE 2434009 A1 * 2/1976 ..... B66B/9/08
DE 30 20 379 A1 12/1981
DE 38 20 055 C1 10/1989
EP 394201 A2 * 10/1990 ..... B66B/9/08
EP 0839751 A1 5/1998
GB 2137589 A 10/1984
GB 2216869 A 10/1989
WO WO 97/45354 A1 12/1997

* cited by examiner

*Primary Examiner*—Eileen D. Lillis
*Assistant Examiner*—Thuy V. Tran
(74) *Attorney, Agent, or Firm*—Edwin D. Schindler

(57) ABSTRACT

A stairlift includes a rail cross-section and mounting rollers which, in combination, allow a stairlift assembly to be achieved which occupies little space and has a reduced visual impact. The rollers engage rolling surfaces arranged about the outer periphery of a tubular rail. The surfaces are preferably defined by structural components of the rail and are preferably non-parallel and non-perpendicular to the stair surfaces upon which the stairlift is mounted.

28 Claims, 15 Drawing Sheets

TRACK FOR STAIRLIFTS

FIELD OF THE INVENTION

This invention relates to stair mounted elevators or lifts, commonly known as stairlifts.

BACKGROUND

A stairlift, in the form of a carriage mounted for movement along a rail, is a well known form of apparatus for moving aged or handicapped persons up and down a staircase. Such a form of apparatus needs to be designed so that the carriage runs smoothly along the rail yet is resistant to forms of movement other than linear movement along the rail. Particular movements which need to be resisted are skewing about the rail, which might cause the carriage to jam as it moves along the rail; tilting of the carriage about an axis transverse of the rail which, unless strictly controlled, can cause the carriage seat to move off the horizontal and alarm a user; and rotation of the carriage about the rail axis which, again, would have an alarming affect on a user.

The desired smoothness of longitudinal movement, as well as resistance to unwanted movement, is typically provided by including within the carriage, spaced pairs of rollers which serve to mount the carriage on the rail. Generally, the greater the distance between the rollers, the more stable the carriage is on the rail. As a consequence rail designs have tended to be quite broad so that the roller spacings can be as wide as possible. This, in turn, has meant that the resulting stairlift has tended to occupy a considerable margin down one edge of a staircase.

Typical prior art stairlifts have at least six pairs of rollers to provide the necessary rolling support to the carriage whilst resisting the undesired movements mentioned above. Obviously the more rollers which are included, the greater the cost. However, even with six roller pairs, some prior art stairlifts still display a degree of uncontrolled movement in the assembly due to the need to provide clearance between opposite sides of the rollers, and the rail.

It is an object of this invention to provide a stairlift which is compact in nature, includes a minimum number of operating parts and feels safe and secure to a user; or to provide a form of stairlift which will at least provide a useful choice.

SUMMARY OF THE INVENTION

Accordingly, in one aspect, the invention provides stairlift apparatus including:

- tubular rail having a substantially uniform cross-section and a plurality of rolling surfaces extending longitudinally thereof;
- carriage mounted for movement along said rail, said carriage being arranged to locate a seat section above said rail and having a plurality of rollers which engage with said rolling surfaces to support said carriage on said rail,
- said apparatus being characterised in that said rolling surfaces are arranged about the outer surface of a tubular rail of non-cylindrical cross section and said rollers are arranged to support said carriage for rolling movement along said rail yet prevent said carriage from rotation about said rail.

Preferably the construction and arrangement is such that said rollers and said rail further operate to resist tilting and skewing movement of said carriage with respect to said rail.

Preferably said rail has at least three rolling surfaces arranged about the outer surface of said rail, a roller contacting each of said rolling surfaces. More preferably said rail includes four rolling surfaces arranged about said cross-section to extend longitudinally of said rail, a pair of longitudinally spaced rollers being provided for each of said rolling surfaces.

Said rolling surfaces are conveniently provided as an upper pair and as a lower pair and said rail preferably further includes rail mounting means defined between said lower pair of rolling surfaces.

The individual rolling surfaces of each pair, and the juxtaposed surfaces of the different pairs, are preferably perpendicular to each other and drive transfer means is preferably provided on or adjacent one of said rolling surfaces. The drive transfer means is preferably provided on one of the upper rolling surfaces.

Whilst the drive transfer means could comprise a section of the rail adapted for frictional engagement with the carriage, said drive transfer means preferably comprises a gear rack.

The apparatus as set forth above may further including rack cover means to at least partially overlie said rack and screen said rack from sight when the rail is viewed from above. This rack cover means preferably comprises a moulding or extrusion fixed above the rack and extending longitudinally of the rail.

The apparatus may further include a drive wheel mounted within said carriage, the periphery of said drive wheel being engageable with said drive transfer means so that, upon rotation of said drive wheel, said carriage is moved longitudinally of said rail; and drive means mounted within said carriage, said drive means having a drive shaft rotatable about a drive axis, said drive wheel being mounted for rotation on said drive shaft; the arrangement being characterised in that said drive means does not overlie said rail when viewed in a direction perpendicular to said drive axis. In such an arrangement, the drive transfer means preferably comprises a rack and said drive wheel comprises a pinion which, in use, engages with said rack.

Preferably all of said rollers which support the carriage on the rail are identical and the mounting arrangement of the rollers is preferably such that each of said rollers is only loaded substantially perpendicular to its respective axis of rotation.

The carriage preferably includes a pair of spaced side plates which extend down to at least partially overlie opposite side parts of said rail, said rollers extending from said side plates. These side plates preferably comprise outer surface parts of said carriage and may include bracing means on the inner surfaces thereof, said plurality of rollers being mounted on said bracing means.

Said side plates and said bracing means are preferably press formed from sheet metal and subsequently welded together.

In order to allow for adjustment of said carriage on said rail, said rollers are preferably provided in co-operating pairs, wherein some of said rollers of each pair rotate about fixed axes whilst the axes of the remainder of said rollers in each pair may be displaced in directions perpendicular to said axes.

In a further aspect the invention provides a stairlift rail having a substantially uniform tubular cross-section and a plurality of rolling surfaces extending longitudinally thereof, the rail being characterised in that said cross section is non-circular and said rolling surfaces are arranged about said cross-section on the outer surface of said rail.

The rail as set forth above preferably further includes a drive surface co-planar with, or parallel to, one of said rolling surfaces, and a rail mounting plane, wherein said drive surface is arranged at substantially 45° to said rail mounting plane.

Preferably said drive surface is constructed and arranged to mount a drive rack.

The rail preferably further includes locating means to receive and locate joining members, said joining members being operable to join like sections of rail together in end-abutting register. Such locating means preferably include a plurality of joining channels formed on the inner surface of said rail, said channels, in use, receiving joining members in the form of pins.

Said rolling surfaces are preferably provided as a lower pair and an upper pair, each of the surfaces of the upper pair being juxtaposed to a surface of the lower pair but having an apex therebetween and wherein a joining channel is formed at or adjacent to the inner surface of each apex.

Said joining channels are preferably substantially circular in section so as to receive, by way of interference fit, joining pins of circular section.

A stairlift rail in accordance with the invention is conveniently formed as an aluminum extrusion.

In still a further aspect the invention provides a stairlift rail for use in the apparatus hereinbefore set forth.

Many variations in the way the present invention may be performed will present themselves to those skilled in the art. The description which follows is intended as an illustration only and the absence of description of particular alternatives or variants should in no way be applied to limit the scope of the invention. Such description of specific elements which follows should also be interpreted as including equivalents whether existing now or in the future. The scope of the invention should be defined solely by the appended claims.

BRIEF DESCRIPTION OF THE DRAWINGS

One form of stairlift incorporating the various aspects of the invention will now be described with reference to the accompanying drawings in which.

DESCRIPTION OF WORKING EMBODIMENT

Figure 1:
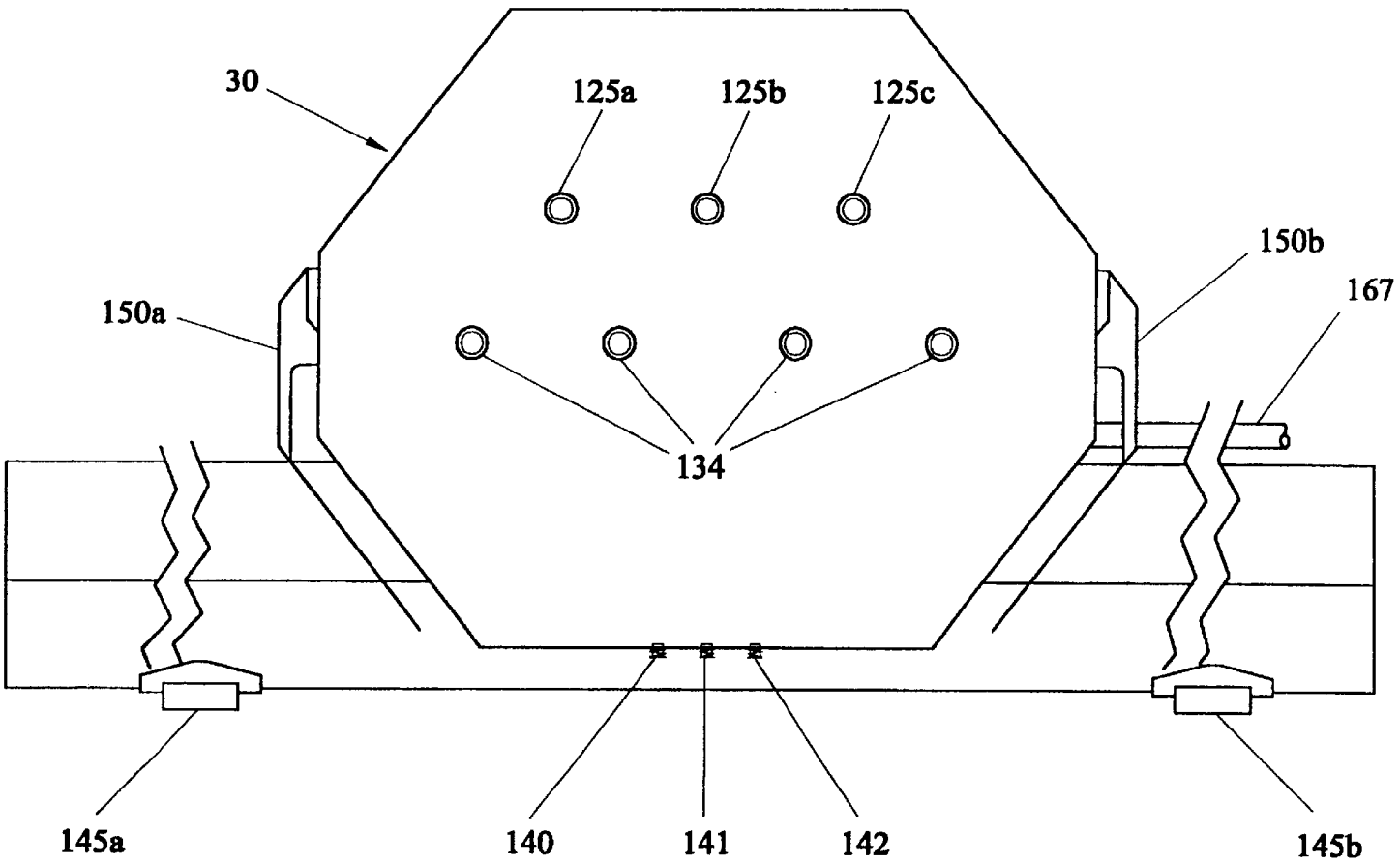
FIG. 1: Shows a side elevational view of a stairlift carriage embodying various aspects of the invention, the carriage being shown, for convenience, mounted on a horizontal rail.

The present invention provides a novel configuration of stairlift apparatus which is un-handed; compact, in that it occupies less space and has less visual impact than typical prior art stairlifts; and also incorporates a reduced number of operating parts with innovative assembly features in order to function efficiently and safely.

In the form shown in the attached drawings, the stairlift includes a carriage 30 mounted substantially above, for movement along, a tubular rail 31 of constant cross section. Two roller sets 32 and 33 (FIG. 2) support the carriage on the rail, the rail and roller configuration being such as to permit smooth movement of the carriage longitudinally of the rail yet prevent tilting, skewing and rotation of the carriage about the rail. In the form shown, each of the roller sets 32 and 33 comprises four rollers, the set 32 being shown in FIG. 4 and comprising rollers 32*a*, 32*b*, 32*c* and 32*d*. The roller set 33 is identical to the roller set 32 but is spaced along the carriage as is evident from FIG. 2.

All rollers of both of the roller sets 32 and 33 are preferably identical.

In accordance with conventional practice, the rail 31 has a rolling surface for the corresponding rollers of the sets 32 and 33, the rolling surfaces being indicated by reference numerals 34*a*, 34*b*, 34*c* and 34*d*. As can be seen, the rolling surfaces are arranged about the cross section of the tubular rail, extend longitudinally of the rail 31 and are formed by the same elements that define the structural elements of the tube. This leads to a compact and structurally efficient rail and is in contrast to typical prior art stairlift rails in which the main supporting rolling surfaces are typically spaced across the rail, often supplemented with vertical surfaces which act as bearing surfaces for anti-skew rollers.

Figure 4:
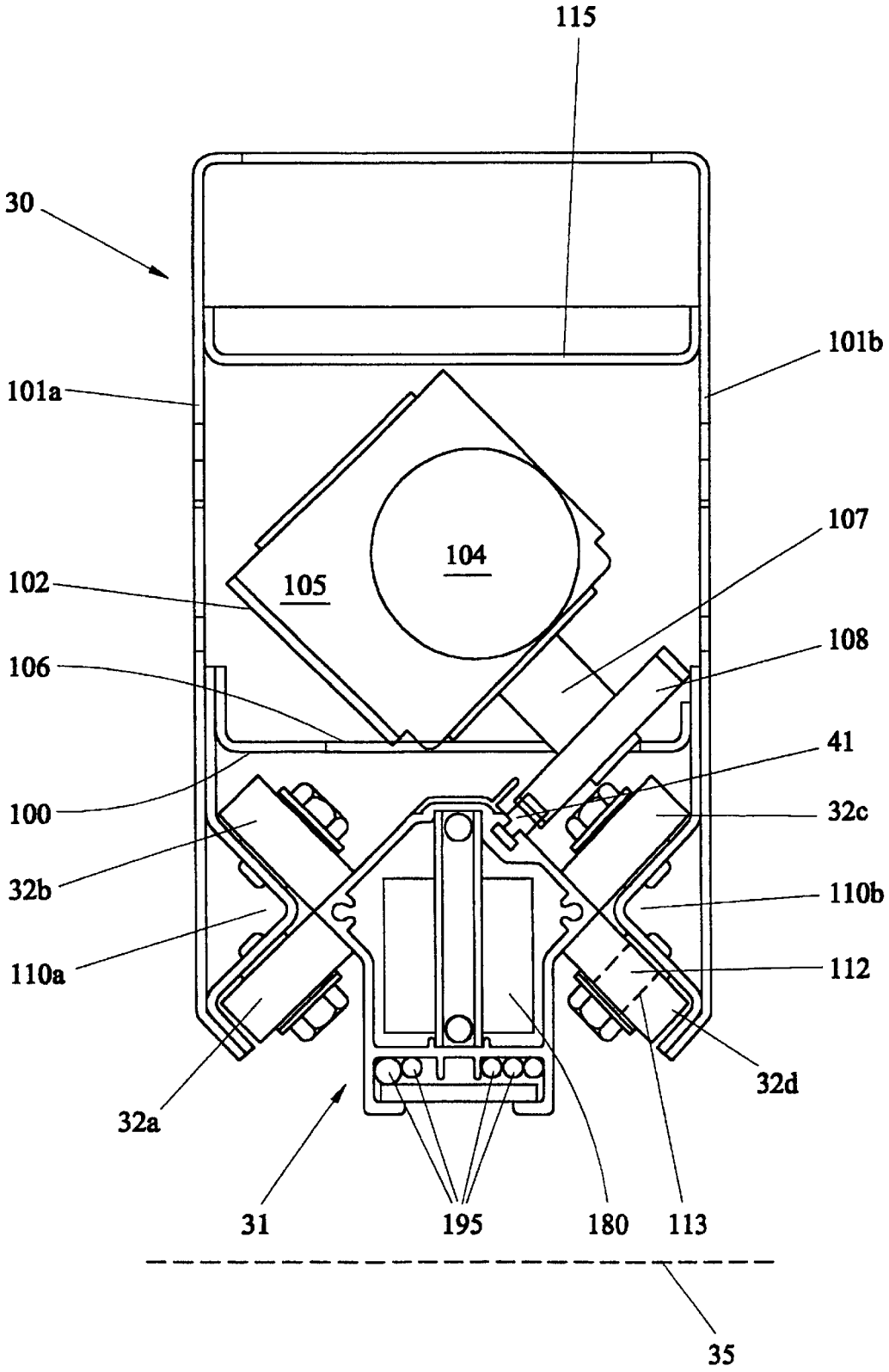
FIG. 4: Shows a end sectional view of the carriage and rail combination shown in FIG. 2 illustrating a roller configuration used to support the carriage on the rail.

As can be seen, each of the rolling surfaces 34*a*, 34*b*, 34*c*, and 34*d* is preferably planar in form and in this form, juxtaposed surfaces are perpendicular. In other words, surfaces 34*a* and 34*b* and surfaces 34*c* and 34*d*, are perpendicular. In addition, the planes of surfaces 34*b* and 34*c*, and 34*d* and 34*a*, are perpendicular in the form shown. To enhance the compact nature of the rail all the rolling surfaces are, unlike prior art stairlift rails, neither parallel to, or perpendicular to, the rail mounting plane 35 (FIG. 4). In the form shown, all surfaces are at 45° to the mounting plane 35.

Figure 6:
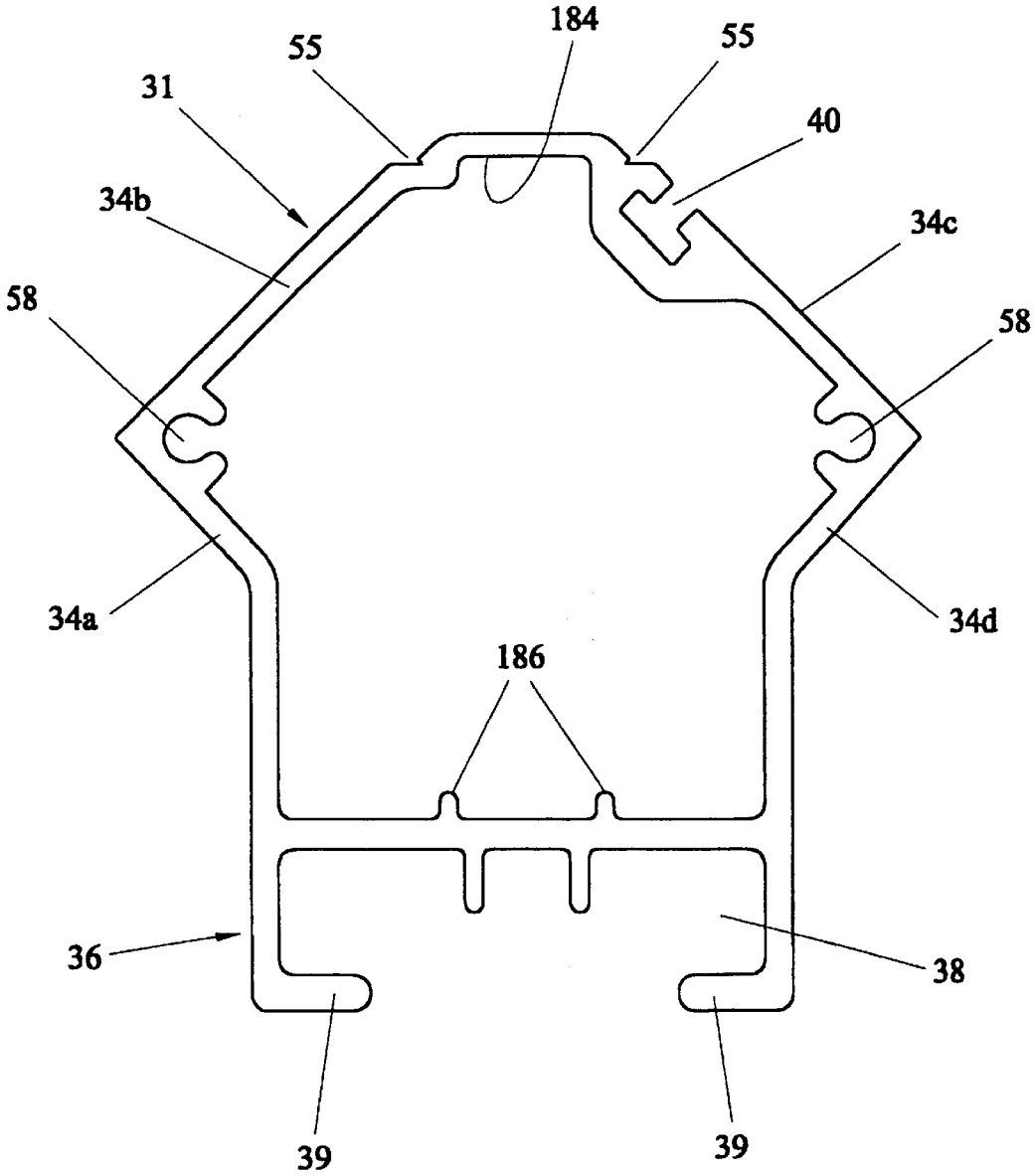
FIG. 6: Shows a cross sectional view of a rail extrusion used in the assembly shown in FIGS. 1 to 5.
Figure 13:
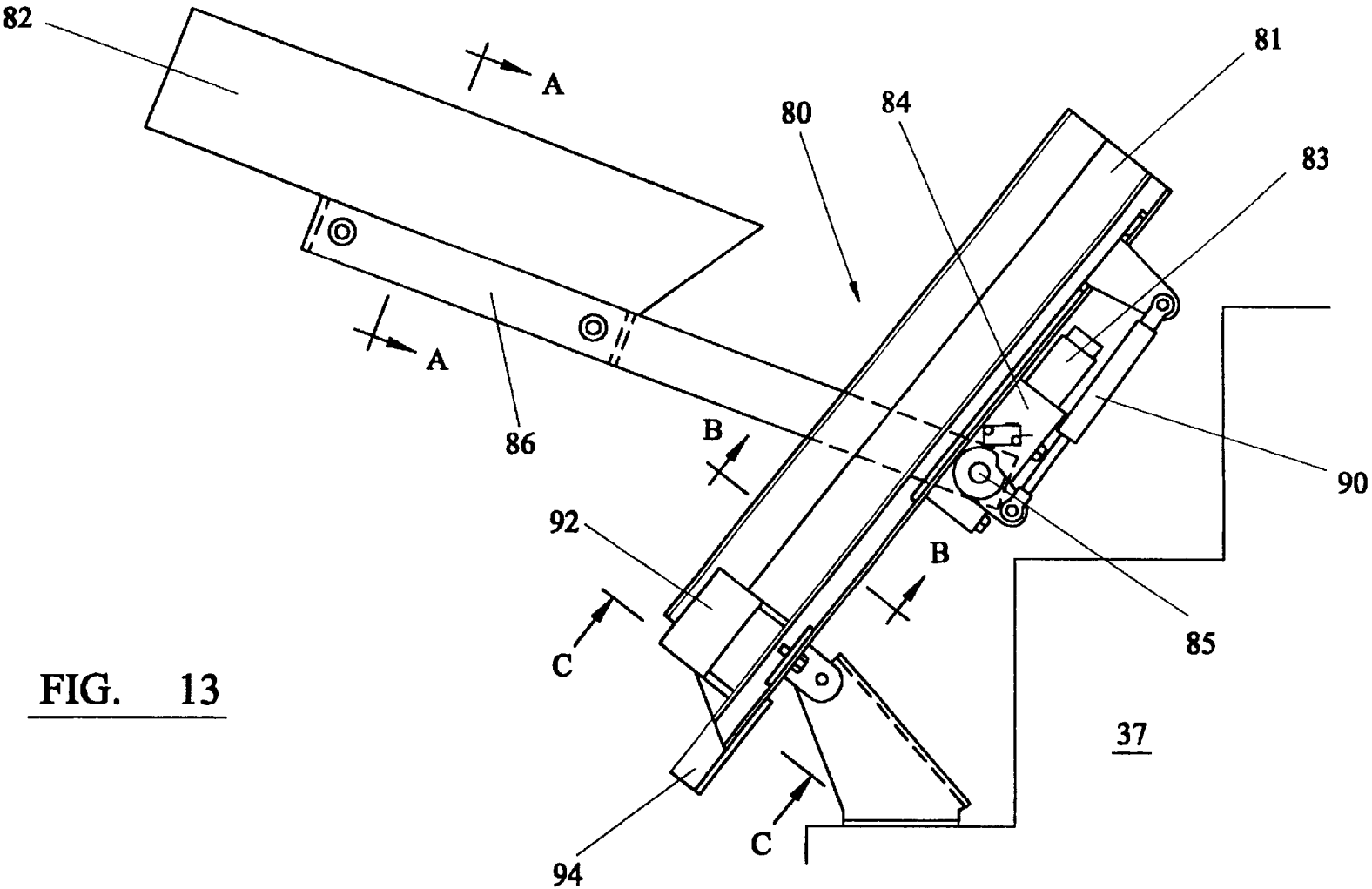
FIG. 13: Shows a side view of a rail hinging mechanism applicable to a stairlift according to the invention.
Figure 14:
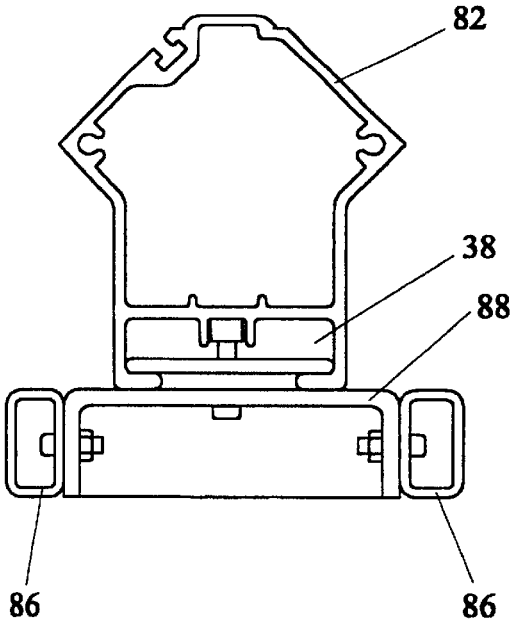
FIG. 14: Shows a view along the line A—A in FIG. 13.

As can be seen in FIG. 6, the surfaces may be viewed as being arranged in upper and lower pairs, the upper pair comprising surfaces 34*b* and 34*c*, and the lower pair comprising surfaces 34*a* and 34*d*. Situated between the lower surface pair 34*a* and 34*d*, is a mounting section 36 which serves to facilitate mounting of the rail 31 on the stairs of a staircase 37 (FIG. 13), and which may also serve as a mounting base for various other components as will be described in greater detail below.

As shown, the mounting section 36 includes a downwardly facing channel 38 having inwardly aligned lower flanges 39.

A drive or traction surface is also provided on the rail, preferably parallel to one of the upper rolling surfaces, in this case the rolling surface 34*c*. It should be appreciated, however, that the drive or traction surface could be provided in a variety of locations about the rail periphery including, for example, on an undersurface of the rail.

Whilst the traction surface could be a surface adapted for friction drive, and thus be a co-planar section or extension of surface 34*c*, in this case the surface 34*c* includes suitable drive mounting means 40 to mount and retain drive transfer means 41, which drive transfer means preferably comprises a rack.

Figure 8:
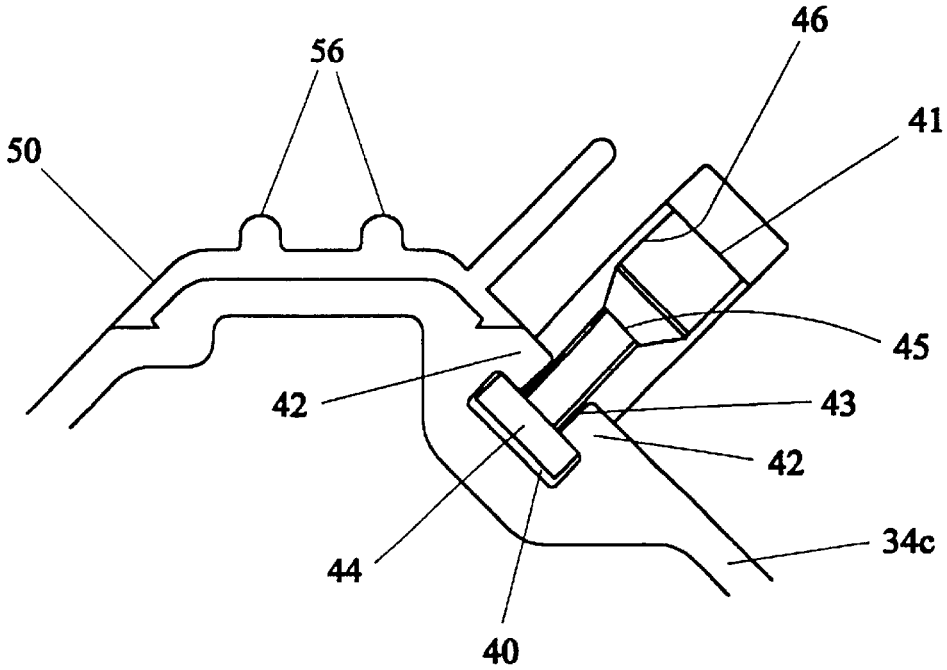
FIG. 8: Shows an enlarged cross-sectional view of part of the assembly shown in FIG. 5 but including greater detail of a rack mounting arrangement according to the invention.

Referring now to FIG. 8, in the embodiment herein described, the drive mounting means 40 comprises a further channel defined in part by inwardly aligned arms 42 having an access slot 43 therebetween. The channel 40 is sized and configured to slidably receive and retain a plurality of fixing bases preferably in the form of captive nuts 44 although these nuts 44 could be replaced by one or more tapped strips which slide into the channel 40. The rack 41 is sized to overlie the access slot 43 and bear on outer surface parts of the arms 42. Fixing means, preferably in the form of machine screws 45, are then passed through countersunk holes 46 formed through the rack 41, passed through the access slot 43 to engage in the captive nuts 44. It will be appreciated that as the screws 45 are tightened in the nuts 44, the rack is drawn down against outer surface parts of the arms 42 whilst the nuts are drawn up against inner surface parts of the arms 42 thus clamping the rack firmly in position.

This arrangement allows the mounting holes 46 to be preformed in the rack and for the rack to be readily mounted in position quickly and accurately, and easily removed and replaced if necessary.

It is envisaged that the rail could be provided with a further channel in rolling surface 34*b*, the further channel being identical in form to channel 40 and being positioned on surface 34*b* so as to be a mirror image of channel 40 about the central vertical axis of the rail. In such a form the rail could be "handed" by the installer, on site.

Figure 9:
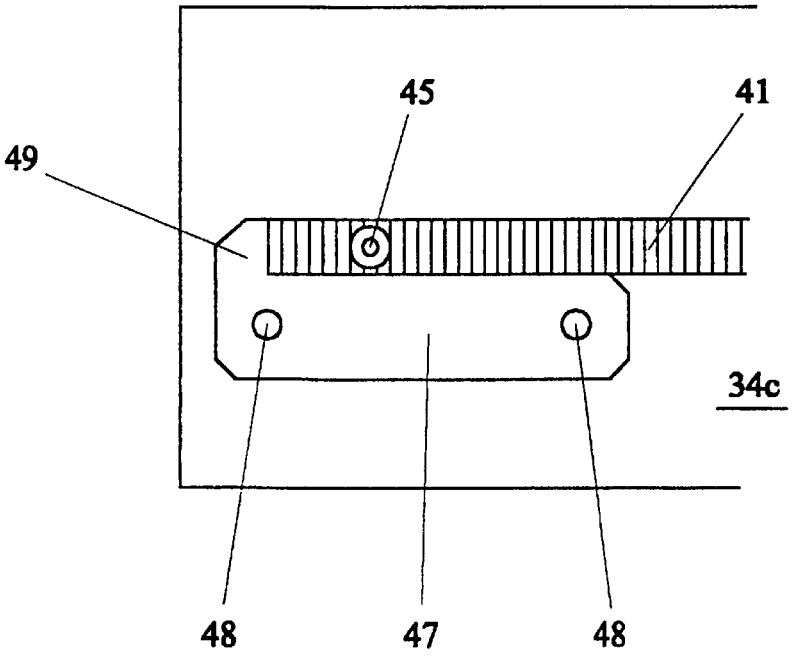
FIG. 9: Shows a plan view of part of the detail shown in FIG. 8.

Referring now to FIG. 9, the rack 41 is further secured at each end thereof by fixing plates 47, one of which is shown in FIG. 9. As can be seen the plate is fixed to surface part 34*c* by machine screws 48 or the like, so as to stand proud of the surface part 34*c*, and includes a step 49 which engages the end of the rack and thus prevents any movement of the rack 41 to the left as shown in FIG. 9. An identical plate (not shown) fixed at the opposite end of the rack 41 prevents movement in the opposite direction. The plates 47 further serve as mechanical safety stops for the carriage as it approaches the ends of the rail in a manner which will be described in greater detail below.

Figure 7:
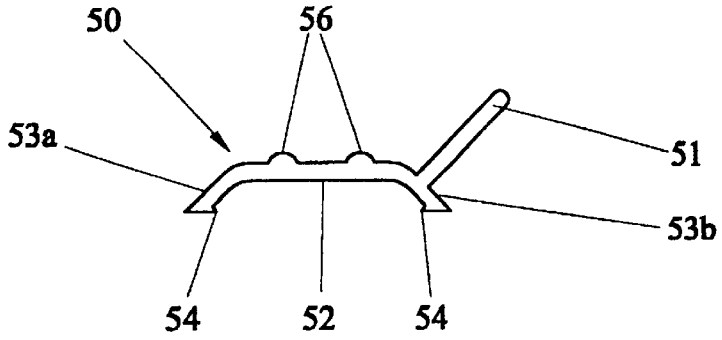
FIG. 7: Shows a cross-sectional view of a rack cover used in the assembly shown in FIGS. 1 to 5.

The rail preferably further includes some means to at least partially cover the rack when the apparatus is viewed from above so as to reduce the possibility of interference with the rack and, hopefully, to enhance the aesthetic appearance of the apparatus. Whilst this cover means could be formed integrally with the rail 31, in the form shown a separate rack cover or masking member 50 (FIG. 7) is provided, preferably in the form of a plastics moulding or extrusion. As can be seen, the member 50 has a covering arm 51 which provides the covering or masking function, and a fixing base 52 which serves to fix the member 50 on to the rail 31. In the form shown, both edges of the base 52 curve down into side margins 53*a*, 53*b* each of which has a fixing lip 54 defined on the lower inner edge thereof. The lips 54 are configured to clip into grooves 55 formed on an upper part of the rail 31 between the rolling surfaces 34*b* and 34*c*. Finally, the cover member 50 preferably further includes a pair of upwardly aligned ribs 56 extending along the upper surface thereof, the purpose of which will become apparent later in this description.

Figure 5:
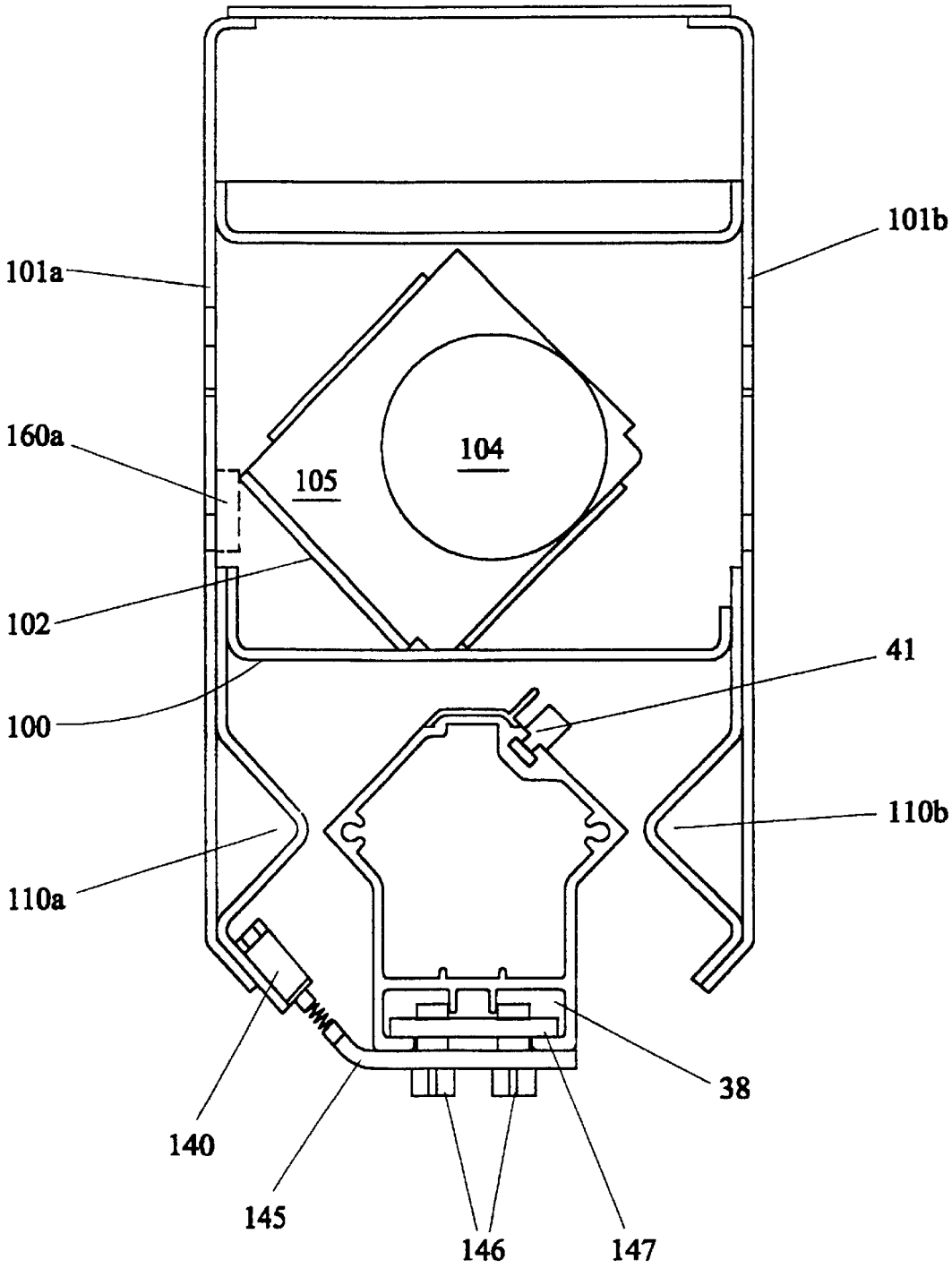
FIG. 5: Shows a further sectional view through the carriage and rail assembly, with a number of components omitted for the sake of clarity, and illustrating certain safety devices included in a stairlift embodying the invention.

It will be appreciated from FIGS. 4 and 5 that, when the cover member 50 is fixed in position on the rail 31, not only is the rack 41 largely hidden from view from above, but also a decorative effect is provided to the upper part of the rail.

Figure 10:
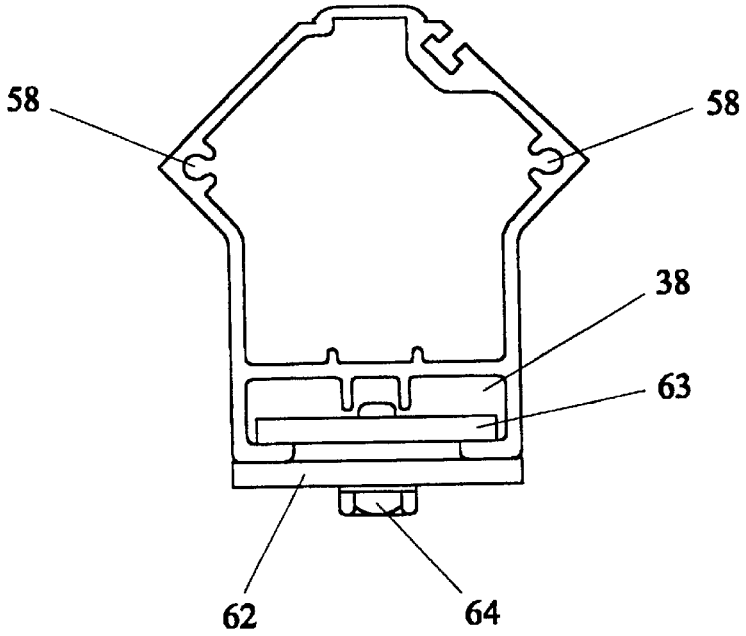
FIG. 10: Shows an end sectional view of a plate arrangement used in a method of joining rail sections according to the invention.
Figure 11:
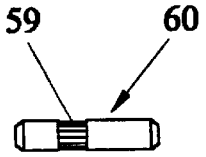
FIG. 11: Shows a joining pin used in a method of joining rail sections according to the invention.
Figure 12:
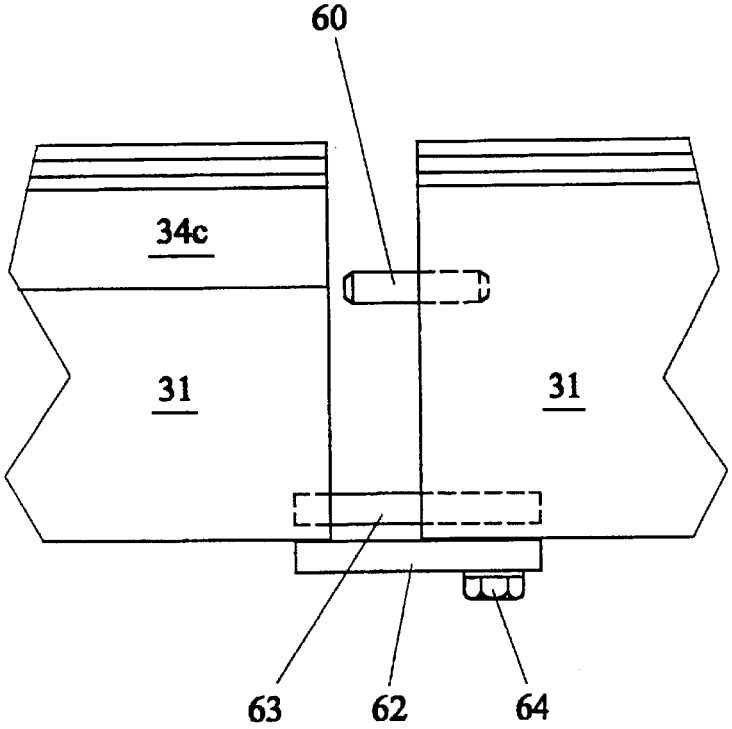
FIG. 12: Shows a partial side view of a two rail sections being brought into end register, and joined, using the components illustrated in FIGS. 10 and 11.

The rail section as above described is conveniently extruded from aluminum. Suitable grades of aluminum include 6063, hardness T6. The rail may be left in its natural, as extruded, form, or may be painted or anodised. Alternatively, the rail could be pultruded in a variety of materials, both metallic and non-metallic (or combinations of metallic and non-metallic) or the rail could even be fabricated from sections of plate material. In many stairlift applications it is necessary to join sections of rail end-to-end in order to increase the effective length of the rail. The present invention partly accommodates this need by providing the rail extrusion with internal joining means which, when two like sections of rail are brought into end-to-end register, can be combined to form a joint between the sections. Referring now to FIGS. 10 to 12, the joining means includes a pair of joining channels 58, formed so as to extend along the inner surface of the rail 31, the channels 58 receiving and retaining joining pins 60. The joining pins 60 are selected or formed to be an interference fit within the channels 58 and are first located in a first one of the rail sections so that, as shown in FIG. 12, parts thereof project out from the first rail section. The second rail section is then aligned with the first section, and moved toward the first section so that the projecting parts of the pins 60 engage in the channels 58 of the second rail section.

As can be seen in FIG. 11, each pin 60 is preferably knurled over part 59 of the outer surface thereof. When each pin is inserted into a channel 58 of the first rail section, it is so inserted until at least part, and preferably substantially all, of the knurled section 59 is located in the channel 58 of the first section. The knurling 59 serves to firmly retain the pins in the channels 58.

Whilst the channels 58 could be located at any points on the inner periphery of the rail 31, the same are preferably located at the inner junctions between the juxtaposed pairs of rolling surfaces 34*a*, 34*b* and 34*c*, 34*d*. In this way, any joint along the rolling surfaces is securely aligned and firmly braced by the joining pins and thus overcomes the problem, experienced with prior art rail joints, in adjacent sections of rolling surface being slightly mis-aligned, thus causing some bumping as the carriage rides over the joint.

The rail joint as described above is preferably braced by outer bracing plates 62 which span the joint. In the form shown the bracing plates 62 are fixed to inner mounting plates 63 located within the mounting channel 38 provided on the lower edge of the rail 31. Machine screws 64 are used to fix the plates 62 to the plates 63.

The channels 58 may serve a further function. At the rail ends, covers (not shown) are typically provided to close off the ends of the extrusion. These covers may be fixed into position by fasteners (not shown) which pass through the covers and engage in the channel 58. Whilst the fasteners could be self-tapping, for this application threaded inserts are preferably inserted in the channels 58.

Figure 17:
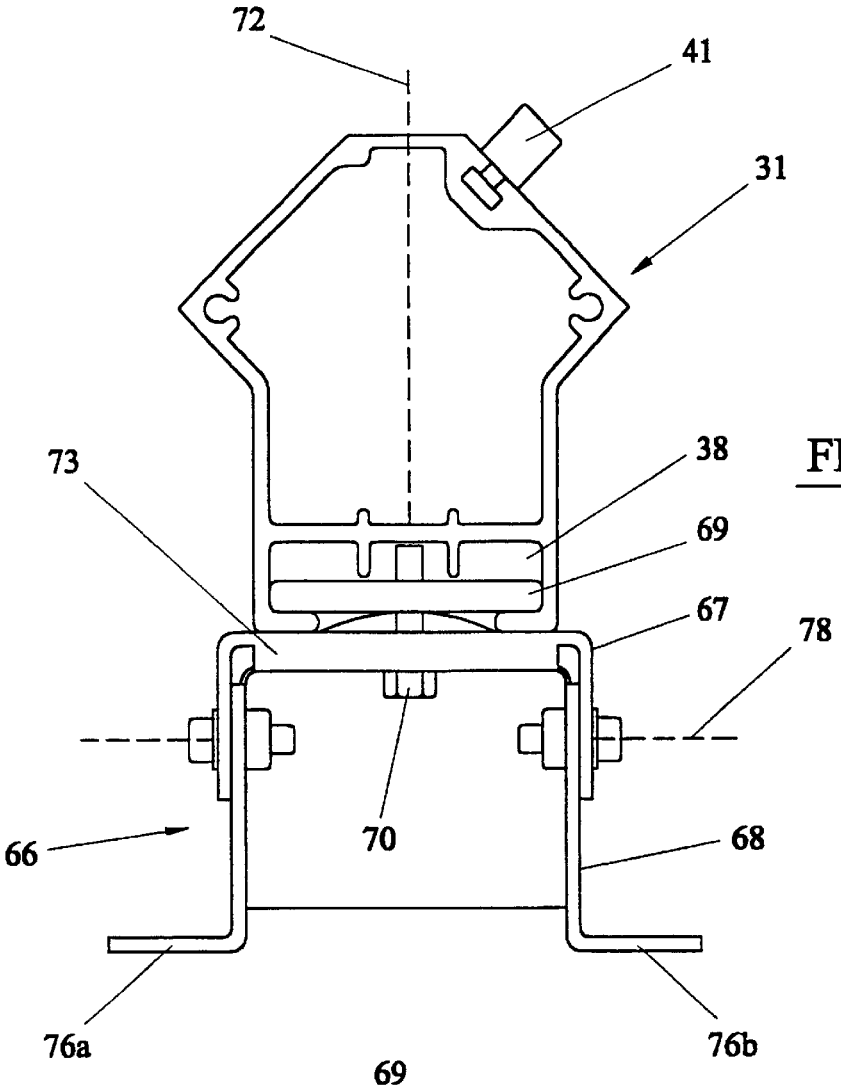
FIG. 17: Shows an end view through the rail section of FIG. 6 assembled on to a mounting bracket according to the invention.
Figure 18:
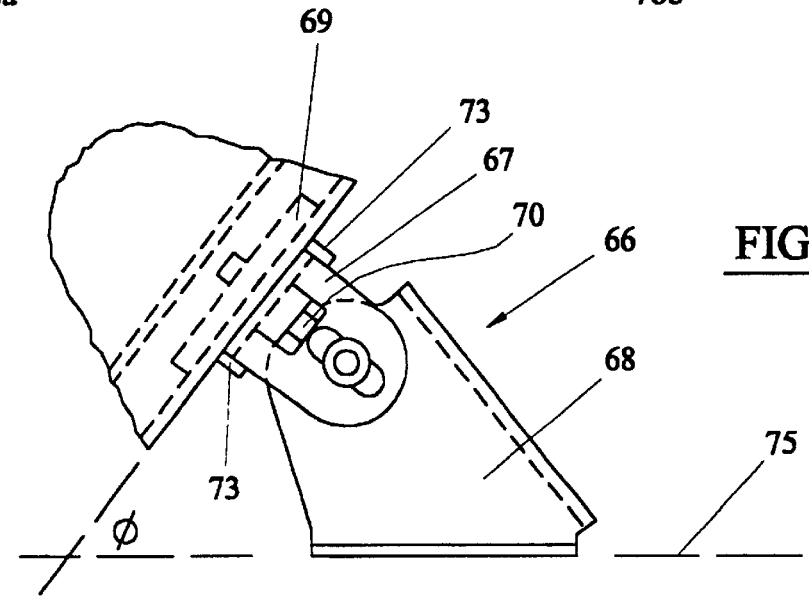
FIG. 18: Shows a side view of part of the assembly shown in FIG. 17.

As described above, the mounting channel 38 serves as a location for mounting means used to mount the rail 31 in a staircase. Referring now to FIGS. 17 and 18, the mounting means may comprise a plurality of like brackets 66, each comprising a rail engaging part 67 and a stair engaging part 68. As can be seen from FIG. 17, the rail engaging part 67 is engaged to the rail 31 through a single lock bolt 70 engaging in lock plate 69 fixed within channel 38. The arrangement is such that, prior to being locked, the bolt 70 defines a pivot aligned with the central vertical axis 72 of the rail. This allows the bracket 66 to be pivoted about the axis 72 before the bolt 70 is locked. With the lock bolt 70 slackened, the lock plate 69, and thus the bracket 66, can be positioned at any point along the rail and the bracket can be rotated about axis 72. When all components have been aligned to the installer's satisfaction, the lock bolt 70 is tightened, thus locking the components in position.

To prevent deformation of the rail engagement part 67, the edges of the centre part thereof are turned down to provide strengthening flanges 73. In addition, the risk of the rail engagement part deforming may be further reduced by press forming the centre section of part 67 to a bell shape, which bell shape projects through the space between lower channel flanges 39 and engages the lower surface of lock plate 69.

The assembly of the rail on a mounting bracket is shown in a horizontal position in FIG. 17, this being an unlikely configuration for a stairlift rail. A more realistic arrangement is shown in FIG. 18 in which the rail 11 is at angle Ø to a horizontal plane 75. The plane 75 is typically represented by a stair tread and we have found, in the past, that there can be considerable horizontal misalignment of stair treads, including mis-alignment across the stair treads. The use of the single central pivot mount described herein allows us to easily accommodate a degree of cross-wise slanting of stair treads as, when the rail is sloped as shown in FIG. 18, pivoting of the bracket 66 about pivot bolt 70 raises and lowers contact feet 76*a* and 76*b*, formed as the lower parts of stair engaging section 68, with respect to one another.

As can be seen, the two parts 67 and 68 are pivoted together along further pivot axis 78 which is orthogonal to axis 72 and allows the brackets to accommodate different rail gradients (differences in angle Ø) as well as a degree of different gradient on the various stair treads.

In some stairlift applications it is necessary or desirable to hinge end sections of the stairlift rail with respect to the main, central part of the rail. Such arrangements are well known in prior art stairlift installations, however, the present invention advances the art by providing not only a simplified form of hinge but also providing a simple yet effective means of mounting the hinge.

Referring now to FIGS. 13 to 16, a hinge mechanism 80 is shown between rail section 81 fixed to the staircase 37, and hinged rail section 82. Whilst the hinge mechanism could be manual in operation, in the form shown the mechanism 80 includes a motor 83 driving a right-angle drive gearbox 84. The motor and gearbox combination is preferably arranged along the rail axis and is conveniently suspended below the fixed rail part 81, being mounted in the fixing channel 38 by suitable fixing bolts (not shown) engaging in captive fixing plates 79 slidable along but lockable within the channel 38. Being mounted in this way, the position of the motor 83 and gearbox 84 can be readily adjusted along the rail part 81, and any misalignment readily eliminated.

With the motor and gearbox being aligned along the rail axis, the output shaft 85 of the right angle drive gearbox lies across the rail and conveniently defines the hinge axis. Thus arms 86 which project from the hinged rail section 82 can be mounted directly on the output shaft 85.

Figure 15:
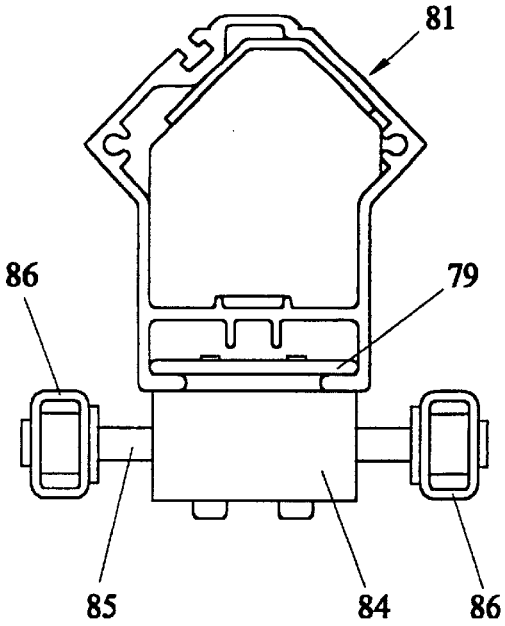
FIG. 15: Shows a view along the line B—B in FIG. 13.
Figure 16:
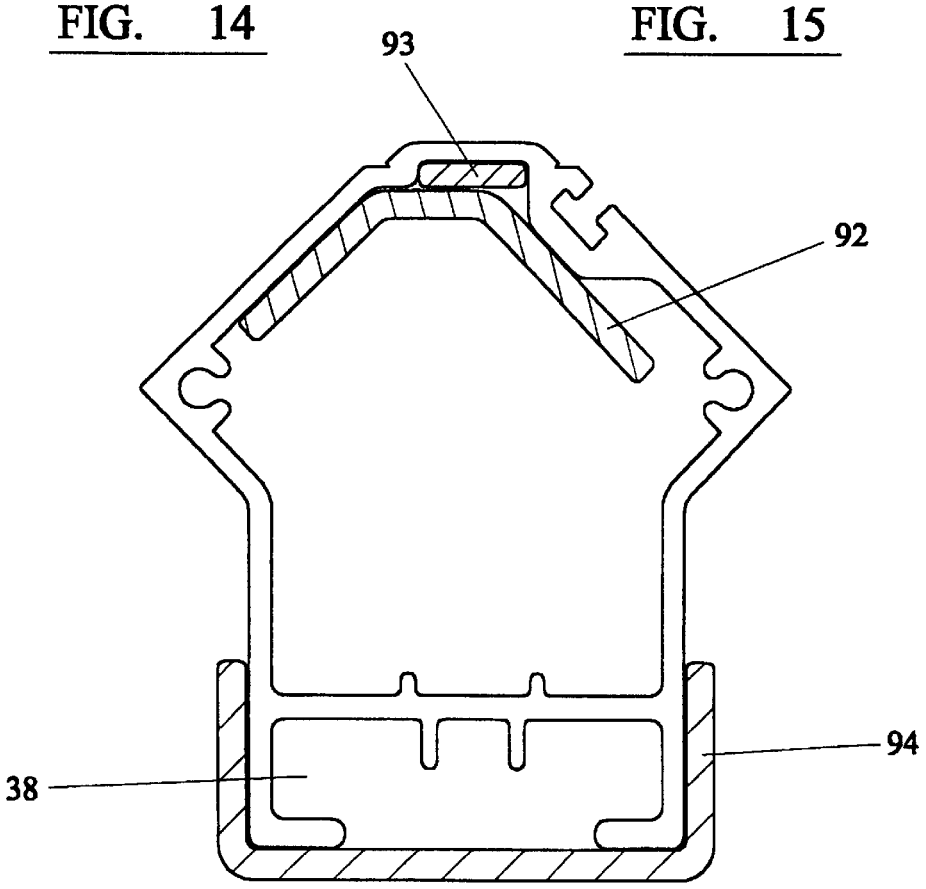
FIG. 16: Shows an enlarged view along the line C—C in FIG. 13.

It will be noted from FIG. 15 that the output shaft 85 emerges from both sides of the gearbox 84 and thus a pair of spaced arms 86 can be provided as a link to the hinged rail section 82.

A mounting bracket 88 is provided on the underside of the hinged section 82 to link the outer ends of arms 86 and to ensure alignment of the rail sections as the hinged section 82 is pivoted down into end alignment with the fixed rail section 81. As can be seen, the bracket 88 is also fixed to the hinged rail section 82 by way of channel 38.

In order to balance the reverse torque imposed on the gearbox 84 by the mass of the hinged section 82, balancing means are preferably provided. In the form shown, this comprises a spring, preferably a gas spring 90. By adding the gas spring 90 a lower powered motor can be used to provide the requisite hinging action.

Suitable support bracing is preferably provided to the mating ends of the rail parts to minimize deformation of the rail parts as the laden carriage travels over the hinge joint. This support bracing can be seen most clearly in FIG. 16 and, in the form shown, comprises an inner bracing channel support 92 which overlies the hinge line and is fixed to the upper inner surface of the fixed rail part. A supplementary bar part 93 may be provided to occupy the cavity formed between the upper part of the support 92 and the inner, upper central surface part of the rail section.

The support bracing may further include an external channel member 94, again overlying the hinge line, which surrounds the lower parts of the two rail sections, when aligned, and prevents outward deformation of those sections when under load. Once again, the channel member 94 is secured to the fixed rail section by bolts (not shown) engaging in suitable fixings (not shown) mounted in the channel 38.

Turning now to a more detailed consideration of the carriage 30, and referring more particularly to FIGS. 4 and 5, the form of carriage depicted includes a main chassis 100 which, when the carriage is mounted in position on the rail 31, spans over the rail. Mounted at spaced points on the chassis 100, preferably along opposite edges of the chassis, are side plates 101*a* and 101*b* which extend down to overlie at least part of both sides of the rail 31. As will be described in greater detail below, the side plates also serve as mountings for the individual rollers of the roller sets 32 and 33.

Included on the chassis 100 is a mounting base 102 which is angled to the remainder of the base and serves as a mounting surface for main drive motor 104 and gearbox 105. The mounting base 102 may be formed integrally with the forming process for the chassis i.e. may be press formed when the chassis is press formed, or may be fixed by welding or bolting to the chassis 100. The chassis 100 also includes a central aperture 106. This gives clearance to enable drive pinion 108, mounted on output shaft 107 of gearbox 105, to engage with drive rack 41 located below the chassis 100 on rail 31.

The lower parts of each of the side plates 101*a* and 101*b* are preferably provided with internal triangulated bracing members 110*a* and 110*b* respectively, the bracing members extending along the carriage and adding considerable stiffness to that section of the carriage which provides the mount to the rail 31. The bracing members also provide convenient mounting points for the rollers of rollers sets 32 and 33. Indeed, the configuration of bracing which provides significant natural strength—a triangle—also perfectly positions the rollers 32 and 33 to engage the perpendicular rolling surfaces of the rail 31. This all helps to ensure that a compact, yet stable, carriage configuration results.

Figure 3:
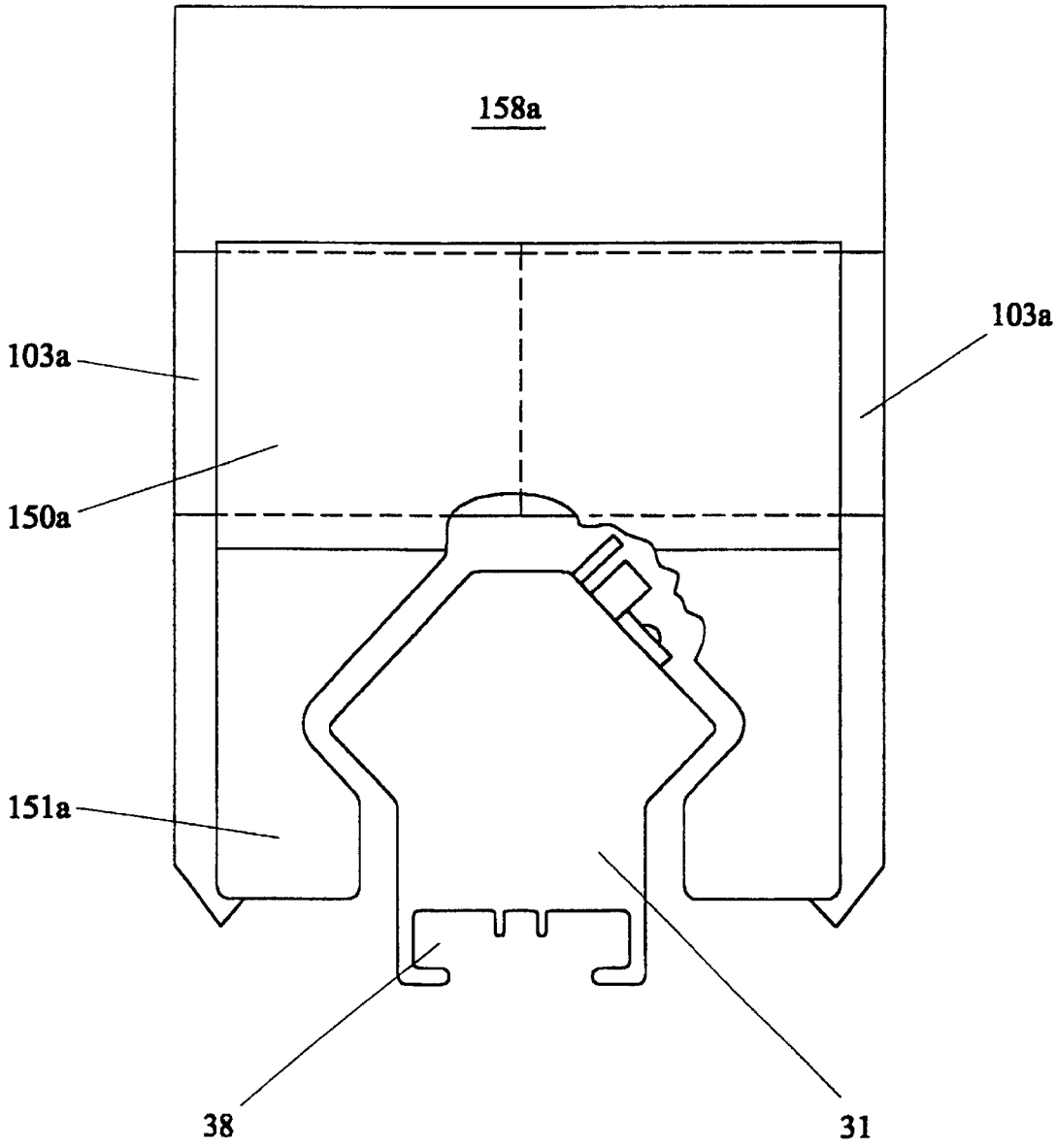
FIG. 3: Shows an end elevational view of the carriage shown in FIG. 1 with the rail shown in outline only.

The carriage is preferably further braced in the vicinity of the roller mounts by folding the centre parts of the side plates 101*a* and 101*b* around to form fixed centre end cover parts 103*a* and 103*b* (shown in dotted outline in FIG. 3). The end cover parts 103*a* and 103*b* are, in turn, fixed to the chassis 100.

The bracing members 110*a*, 110*b* include threaded bosses to receive axle pins 112 and sleeves 113 which mount each of the rollers 32, 33. The sleeves 113 which mount the top rollers 32*b*, 33*b* and 32*c*, 33*c* are preferably provided with concentric through bores whilst those which mount the lower rollers 32*a*, 33*a* and 32*d*, 33*d* are preferably provided with eccentric through bores. This allows the axes of the rollers 32*a*, 33*a* and 32*d*, 33*d* to be adjusted toward and away from the rolling surfaces 34*a* and 34*d* respectively, and thereby allow any slack between the carriage and the rail, to be easily and effectively taken up. As an alternative, the axes of the rear roller sets 32*c*, 33*c* and 32*d*, 33*d* could be fixed whilst those of the front sets 32*a*, 33*a* and 32*b*, 33*b* could be provided on eccentrics so as to provide the necessary adjustment.

It will be appreciated, when viewing the arrangement shown in FIG. 4, that all the rollers 32, 33 are in positive engagement with the rail at all times, thus ensuring smooth travel of the carriage longitudinally of the rail whilst preventing tilting, skewing or rotation of the carriage about the rail. Further, this secure and smooth form of motion can be achieved using two sets of four identical rollers rather than the six, often varied, sets of rollers typically found in prior art stairlifts.

The rollers 32, 33 may be formed from any suitable material, one example being nylon which is preferably impregnated with molybdenum sulphide.

With the drive transfer means 41 being in the form of a rack, the drive wheel 108 comprises a compatible pinion. However, it will be appreciated that the drive transfer means could comprise a simple surface, perhaps patterned or roughened, and the wheel 108 a simple wheel arranged to frictionally engage the transfer surface.

With the arrangement shown, the motor 104 and gearbox 105 are spaced away from the rail and, when viewed in a direction perpendicular to the axis of output shaft 107, the motor and gearbox combination do not overlie the rail 11. This allows the gearing of the stairlift to be simply varied by varying the diameter of the wheel 108 and providing varying thickness packing between the gearbox 105 and mounting base 102, this being possible without encountering problems of the motor/gearbox fouling on the rail. Alternatively, the rack 41 could be packed upwardly to correctly engage a smaller diameter pinion 108.

In particular, the arrangement depicted and described permits the use of small, standard size pinions to be used in combination with a relatively inexpensive single stage gearbox rather than the more expensive step down gearboxes typically used heretofore.

It will also be seen that the pinion 108 engages rack 41 which is located on one of the upper rolling surfaces 34*c* whilst the gearbox substantially overlies, but is spaced from, the other upper rolling surface 34*b*. Thus the mass of the carriage is relatively evenly arranged about the central axis 72 of the rail, which assists the overall stability of the stairlift.

It will also be seen that the side plates 101*a* and 101*b* also preferably comprise part of the outer surface of the carriage. A further cross member 115 may, as shown, be provided which projects between upper parts of the side plates 101 to stiffen the carriage and serve as a mount for other components as will be described in greater detail below.

The chassis 100, side plates 101, bracing members 110 and cross member 115 are preferably all press formed from sheet metal, and are then located in a jig, and spot welded together. This considerably simplifies fabrication of the carriage and enables a lighter structure to achieve desired strength parameters.

Figure 19:
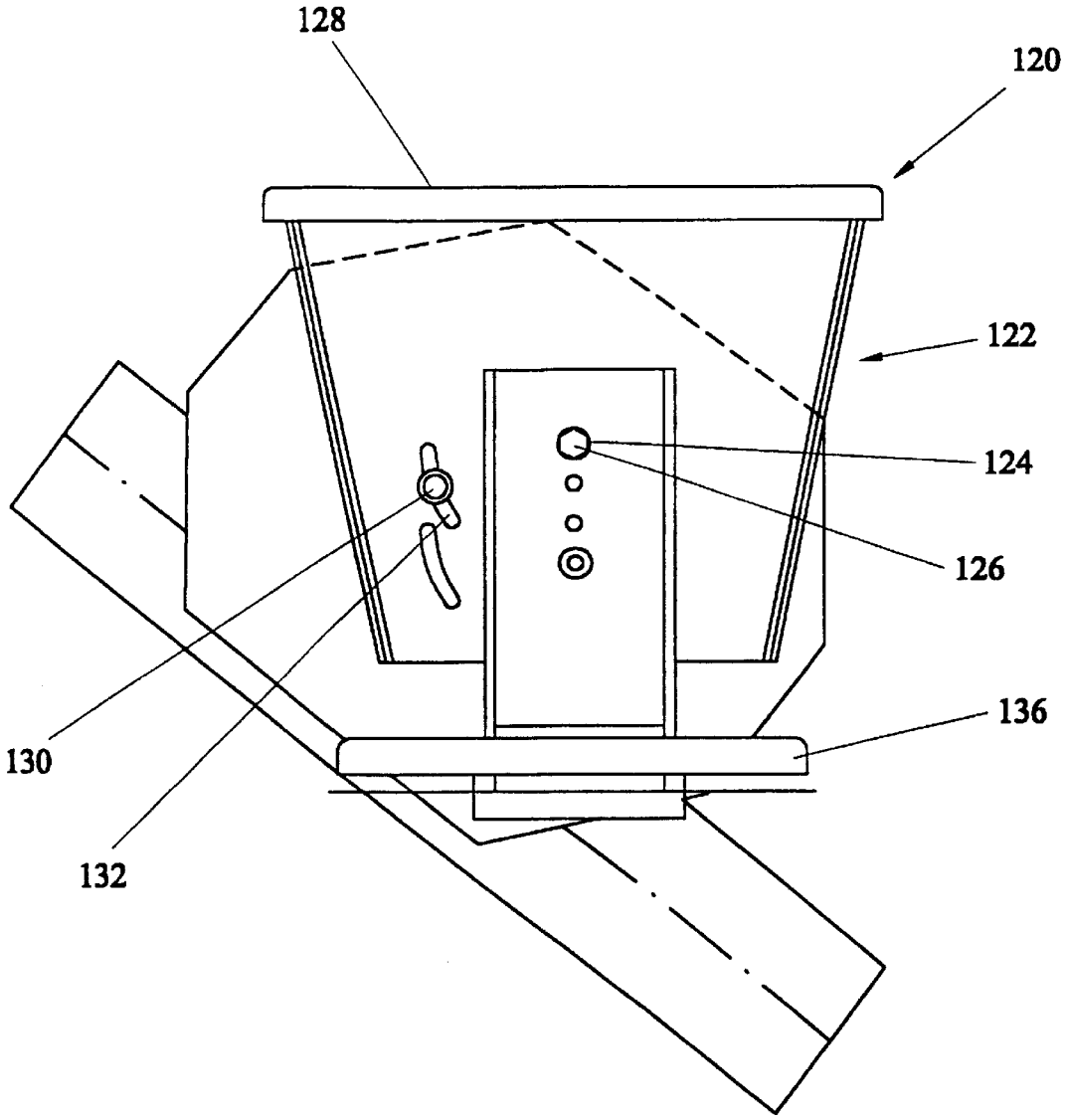
FIG. 19: Shows a side elevational view of a chair interface unit mounted on the carriage and rail combination shown in FIG. 1.

The carriage 30 also includes a novel arrangement for mounting a stairlift chair (not shown) on the carriage. As can be seen in FIG. 19, chair interface unit 120 is mounted on the carriage 30, the interface unit 120 having downwardly extending side members 122 which at least partly overlie the side plates 101*a* and 101*b* of the carriage 30. A central mounting hole 124 in each of the side members 122 is aligned with one of mounting bosses 125*a*, 125*b* and 125*c* (FIG. 1) fixed in the side plates 101 of the carriage. A mounting bolt 126 is then passed through the aligned hole, and engaged in the selected boss, to provide pivotal support for the interface unit, and thus the chair. After the chair cushion (not shown), mounted on the upper surface 128 of the interface unit, has been set to the desired angle, a locking bolt 130 is passed through one of the arcuate slots 132, in the interface unit, which has a locking aperture 134, in side plate 101, exposed thereunder, and is engaged in the aperture 134 and tightened to fix the chair in position.

It will be noted that interface unit 120 also serves as a mounting point for footrest 136.

The provision of a series of mounting bosses 125, and corresponding locking apertures 134, provides further benefit in that the interface unit 120, and thus the chair, may be offset with respect to the carriage. This, in turn, allows additional clearance to be achieved, when required, at one end of the stairlift and minimises or eliminates the problem of rail overhang.

Official regulations or standards require that stairlift installations include various safety features to minimise accidental harm to users of the installation or to persons who may come into contact with the stairlift during operation. One requirement is that the stairlift carriage be brought to a halt, without manual intervention, when it reaches the ends of the rail. This is to ensure that the carriage is not inadvertently powered off the rail. Another requirement is that the carriage be brought to a halt in the event the carriage encounters an obstacle in its path whilst travelling along the rail.

Various switch configurations have been used in the past, of varying degrees of complexity and reliability. The present invention proposes several novel features which are believed to provide relatively simple yet effective and reliable switch operation.

Figure 2:
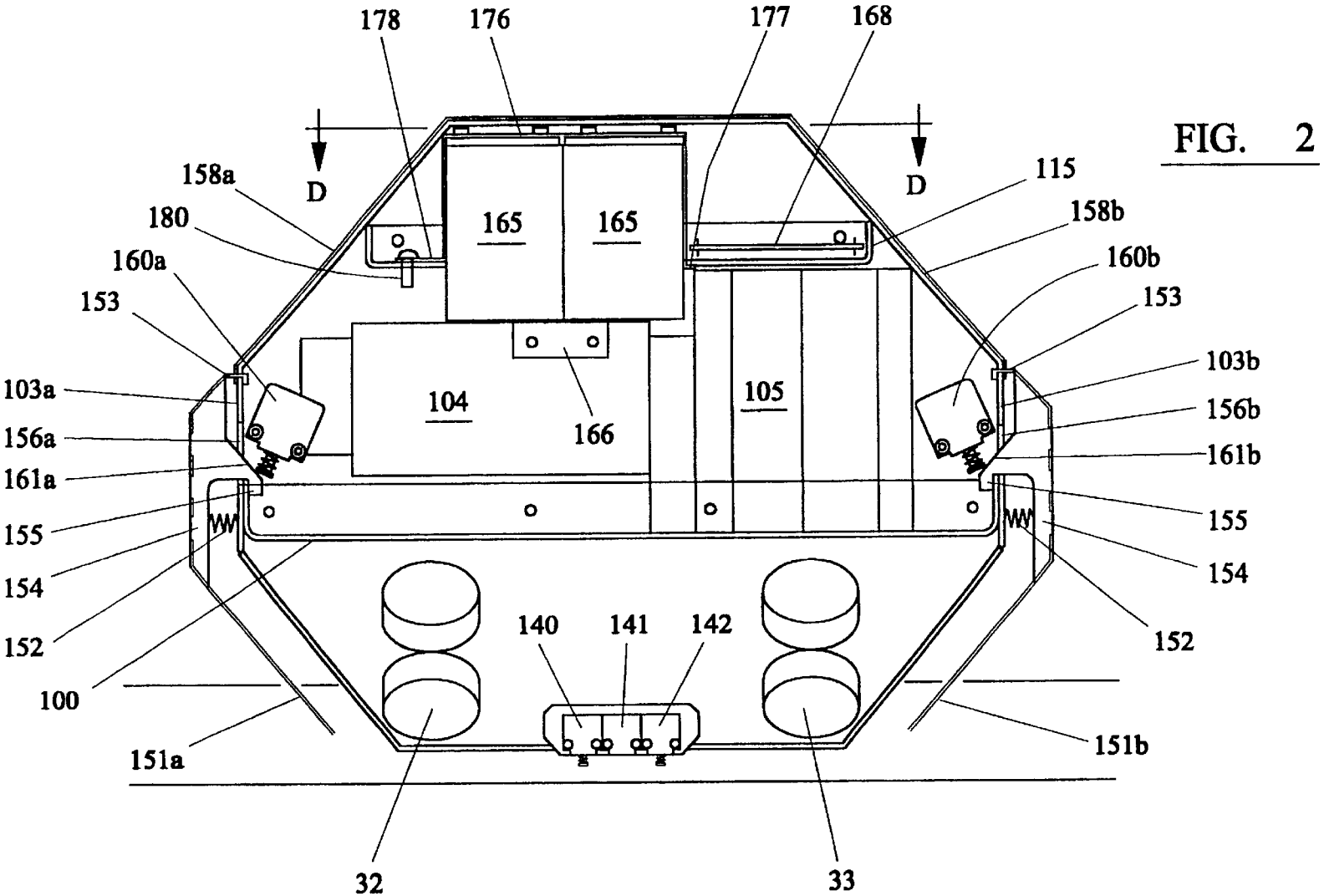
FIG. 2: Shows a sectional view, part schematic, through the carriage and rail combination shown in FIG. 1.

Referring to FIGS. 1, 2 and 5, the end stop switching is provided by a bank of three stop switches, a first switch 140, second switch 141 and third switch 142, the bank of switches being mounted on the lower inner surface of side plate 101*a* and being positioned so that the centre switch 141 lies on, or very close to, the vertical geometric centre of the carriage when the carriage is viewed in the position shown in FIG. 2. Switch operating means 145*a*, 145*b* are mounted at or adjacent each end of the rail. As the carriage arrives at the end to the left in FIG. 1, the switch 140 contacts the switch operating member 145*a* and cuts power to the motor 104. Should the switch 140 fail to operate, the carriage continues until ultimate or back-up switch 141 engages the member 145*a* and cuts power to all electrical components in the carriage.

When the carriage is moving in the opposite direction, switch 142 first contacts switch operating member 145*b*. If switch 142 fails to operate then ultimate or back-up switch 141 is again brought into play, but this time through contact with member 145*b*.

All three switches 140, 141 and 142 are preferably identical.

There is a further advantage arising from the nature of the switch operation members 145. The members 145*a* at both ends of the rail are preferably identical and are conveniently mounted using mounting channel 38. In the embodiment shown, the members 145 are locked into positions by locking bolts 146 acting in captive nuts 147 slidable within the channel 38. In this way, the safety stopping positions at either end of the rail can be easily adjusted and reliably fixed.

A further safety back-up is provided to supplement the switches 140, 141 and 142. In the event the back-up switch 142 also fails to cut power to the drive motor 104, the structure of the carriage is designed to foul on rack retaining member 47 which acts as a mechanical barrier to further movement of the carriage.

According to a further aspect of the present invention, it is also proposed to provide a simple yet effective form of safety cut-out to stop the carriage 30 in the event the carriage encounters an obstacle in its path intermediate the rail ends.

As with prior art devices the carriage 30 includes hinged means which, in the form shown, comprise flaps 150*a* and 150*b* mounted on opposite ends of the carriage 30, the flaps 150 being preferably folded or press formed from single section s of sheet metal. As can be seen from FIGS. 1 to 3, the flaps have lower sections 151 which extend down to lie on opposite sides of the rail 31. Springs 152 acting between the flaps 150 and the carriage ends bias the flaps away from the carriage ends.

The upper part of each flap 150*a*, 150*b* has an inwardly turned lip 153 which engages over the upper edges of carriage end parts 103*a*, 103*b* to provide a pivotal mount for each flap.

Each flap further includes side flanges 154 which are formed with hooked keepers 155. The keepers 155 are configured to engage over the lower edges of slots 156*a* and 156*b* formed in the carriage end parts 103*a* and 103*b* to thus limit the displacement of the flaps by the springs 152. The flaps 150 are held down in position over carriage end parts 103 by upper cover sections 158*a* and 158*b*, the upper cover sections further contributing to the enclosure of the interior of the carriage 30.

Thus the components combine to provide a simple reliable form of hinge using the least number of components. Further, it will be noted that the cut-out switches 160*a* and 160*b*, operated respectively by flaps 150*a* and 150*b*, require no separate operating linkages, the switches acting directly on ramps 161*a* and 161*b* forming part of the reverse side of the keepers 155.

It will be appreciated that as a flap 150*a*, 150*b* encounters an obstruction in the path of the carriage, the flap is deflected against the bias of spring 152 and operates the respective cutout switch 160*a*, 160*b* which brings the carriage to a halt.

Turning now to FIGS. 1, 2 and 22 to 24, in the form of apparatus depicted and described herein, motor 104 is a DC motor which receives electric energy from batteries 165 mounted in the upper part of the carriage 30. The batteries are preferably charged, continuously throughout each operating cycle, from a trailing cable 167, the cable 167 being controlled in a manner which will be described in greater detail below.

Obviously, the motor 104 could, instead, be an AC motor receiving AC power via the trailing cable 167.

As shown, the batteries 165 rest under their own weight on lower support member 166, the lower support member 166 extending between side plates 101*a* and 101*b* but below cross member 115. The cross member 115 is preferably of tray-like form and conveniently serves as a mount for much of the electronics included in the carriage 30. To this end circuit board 168, which provides the main electrical control function for the stairlift, is mounted on cross member 115. As can be seen, the cross member 115 also includes a rectangular aperture 170 which, in combination with lower support member 166, defines a bay to securely locate the batteries 165. The aperture 170 is sized so that, when seated within the bay, the batteries are restrained against substantial lateral movement.

Electrical cables connecting the various safety cut-out switches and the circuit board 168 are formed into the arms of a loom, parts 172 of the loom being held into the sides of the battery bay by interaction between the batteries and the bay or, more particularly, between the batteries 165 and the cross member 115. To this end, the perimeter of aperture 170 in the cross member is provided with notches 174 into which the loom parts are first located and then trapped by the presence of the batteries 165. This simple feature allows the loom parts 172 to be securely located in position whilst avoiding the need for cable ties or the like.

The batteries 165 are restrained against upward vertical displacement by a restraining member 176 which spans across the batteries and engages the cross member on opposite sides of the batteries. As can be seen from FIG. 2, one side of the restraining member includes a lip 177 which, prior to the insertion of batteries 18, is engaged under one edge defining aperture 170. Once the batteries 165 are in position, the lip 177 is prevented from disengagement with the aperture edge. The other end of the retaining member is formed into a fixing flange 178 which is held in position by a single fastener 180 which screws into the cross member 115.

The restraining member 176 is preferably stamped or otherwise formed from metal sheet.

In this way a simple, single piece battery restraint is provided which requires only one fastener to be fixed in place.

The assembly and reliability of the electrical systems is further enhanced by selecting switches of common form and arranging these switches into a sub-assembly for the manufacturing process.

As stated above, switches 140, 141 and 142 are preferably identical in form. Switches 160*a* and 160*b* are also preferably of the same form and identical to the switches 140 to 142. As can be seen from FIG. 5, all switches are mounted on the one of the side plates 101, thus allowing the side plate to be pre-wired before final assembly of the carriage. This simplifies the assembly process. In the form shown, the switches are mounted on the outer side plate 101*a* i.e. the side plate facing away from the wall when the stairlift is mounted in its operating position. This simplifies servicing and replacement of the switch gear.

To allow the pre-wiring to be successfully incorporated, the chassis 100 is provided with a slot (not shown) in the edge thereof which mates with side plate 101*a*. This slot accommodates the loom when the pre-wired side plate 101*a* is offered up to the chassis.

As mentioned above, the batteries 165 are preferably charged on a continuous basis throughout all operating cycles of the apparatus, by means of a trailing cable 167 permanently wired into an external power source. A charger (not shown) is obviously wired into the supply circuit and may be located in the carriage or external to the apparatus and most likely, conveniently close to the external power source. Typical prior art DC powered stairlifts have charging ramps at opposite end of the rail. This means that the batteries are only charged when the carriage is in position at an end of the rail. Further, the ramps are subject to wear and tear, and mis-alignment, which often results in the charging function failing and the batteries running out of charge. The trailing cable arrangement means that the batteries are charged at all times.

This invention also proposes a novel form of mechanism for controlling the trailing cable 167.

It is known to provide a trailing cable arrangement in which a power cable extends out the front face of the carriage adjacent the rail upper surface, passes around a pulley fixed adjacent the upper end of the rail, is engaged with a weighted trolley which can travel inside the rail and is then connected to an external source of electrical power. The cable must be of sufficient length to ensure power supply when the carriage is at the bottom of the rail. The trolley functions to draw excess cable into the rail interior as the carriage moves up the rail.

Figure 24:
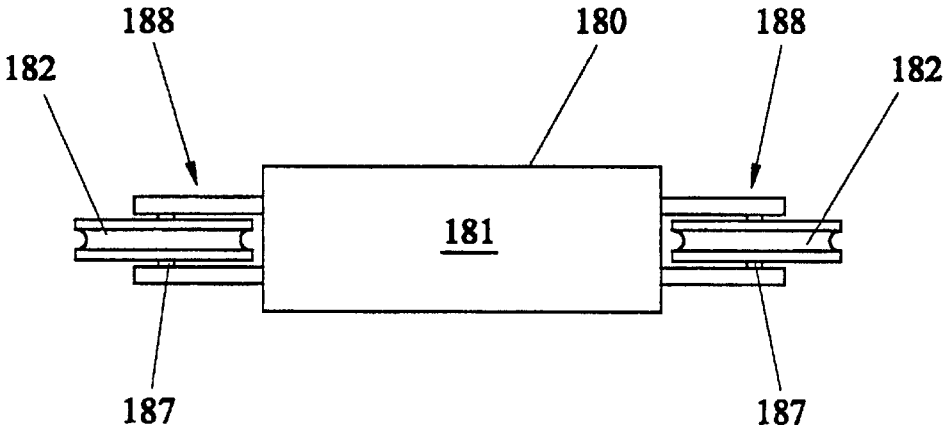
FIG. 24: Shows a plan view of the tensioning means shown in FIG. 23.
Figure 23:
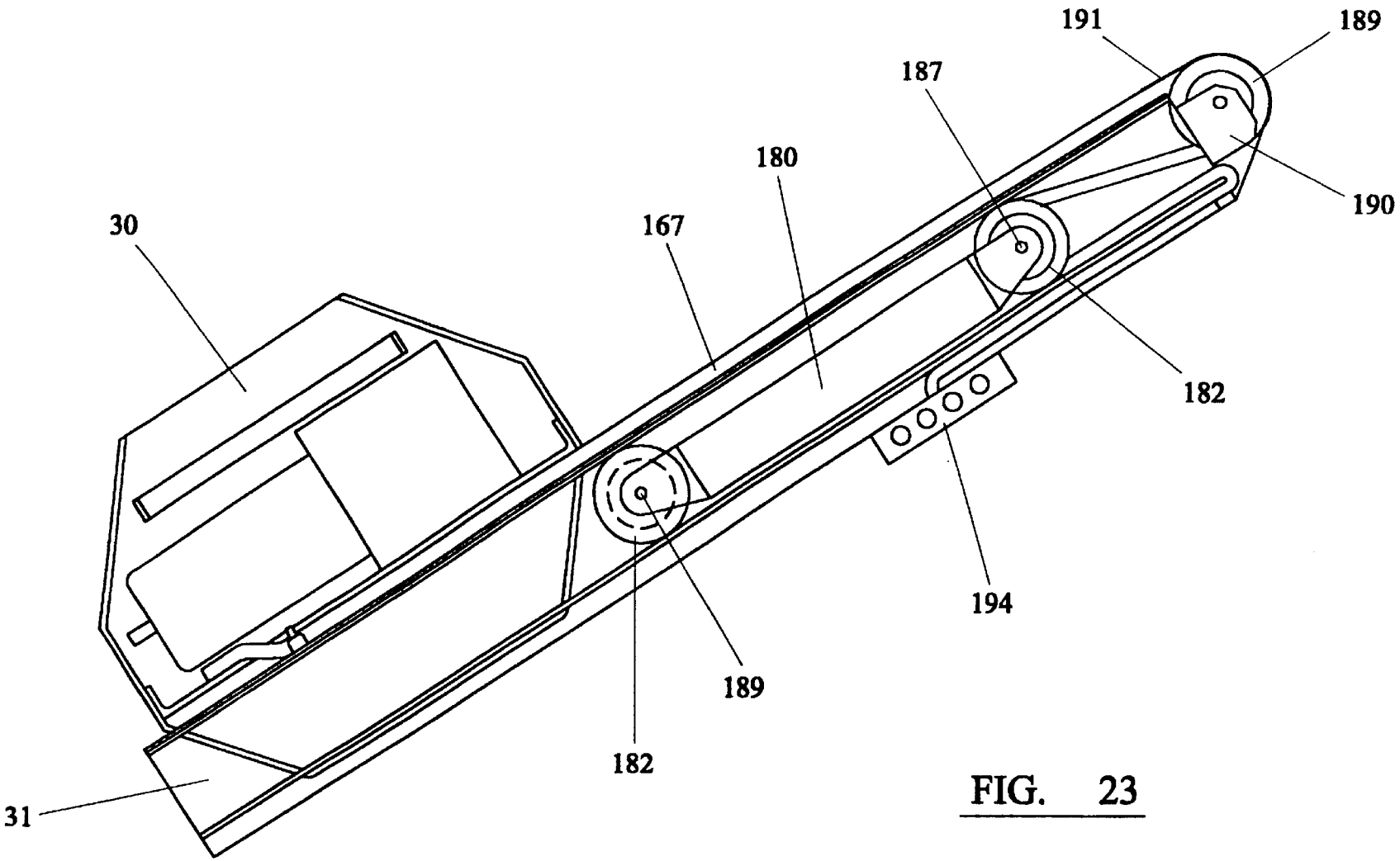
FIG. 23: Shows a side sectional, schematic view of a rail, a carriage and cable tensioning means, according to the invention, located within the rail.

Referring now to FIGS. 23 and 24, a novel form of trolley 180 is shown having a weighted rectangular body part 181 supported in the interior of the rail 31 on a pair of spaced rollers 182. As can be seen in greater detail in FIG. 6, the rail has an upper channel 184 and lower upstanding ribs 186 which serve to locate the rollers laterally.

The rollers 182 are both preferably identical and are of a diameter which is accommodated, with little clearance in the vertical inner section of the rail.

The trolley body 181 is formed from a heavy material such as solid iron or lead so that the trolley is always biased, under its own weight, towards the lower end of the rail and thus maintains tension on the cable 167. The body 181 has forked sections 188 fixed to opposite ends thereof to receive the rollers 182 mounted on axles 187.

The novelty of the present arrangement resides in the fact that at least the leading roller 182, and preferably both rollers, have their rolling peripheries shaped to accommodate the trailing cable 167. Thus, the cable 167 is lead from the carriage, directed about pulley 189 mounted at the upper end of the rail in bracket 190, fed around leading roller 182 of the trolley, and then lead out and engaged with the external power source. Between the carriage and the pulley, the cable 167 may be partly located by the ribs 56 extending along the upper surface of the rack cover member 50.

Pulley 190 is preferably enclosed within end cap 191. Both the bracket 190 and the cover 191 are fixed to the rail by fasteners (not shown) engaging in threaded inserts (not shown) fixed in channels 58.

It will thus be seen that the rollers 182 both locate the cable and support the trolley, reducing the complexity of the apparatus and reducing cost and assembly requirements. Further, the same trolley can be used in right and left handed installations without modification.

That end of the cable 167 not connected to the carriage 30 is preferably connected to a junction box mounted on the rail but in a position which does not interfere with movement of the carriage along the rail.

Figure 20:
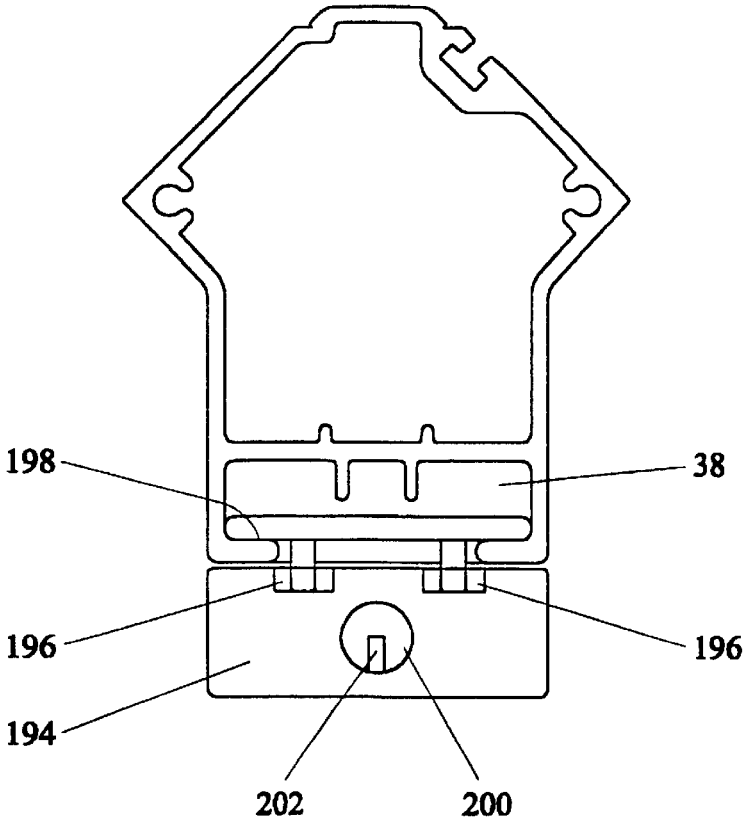
FIG. 20: Shows an end sectional view through the rail extrusion shown in FIG. 6 with an electrical junction box, also shown in section, assembled thereon.
Figure 21:
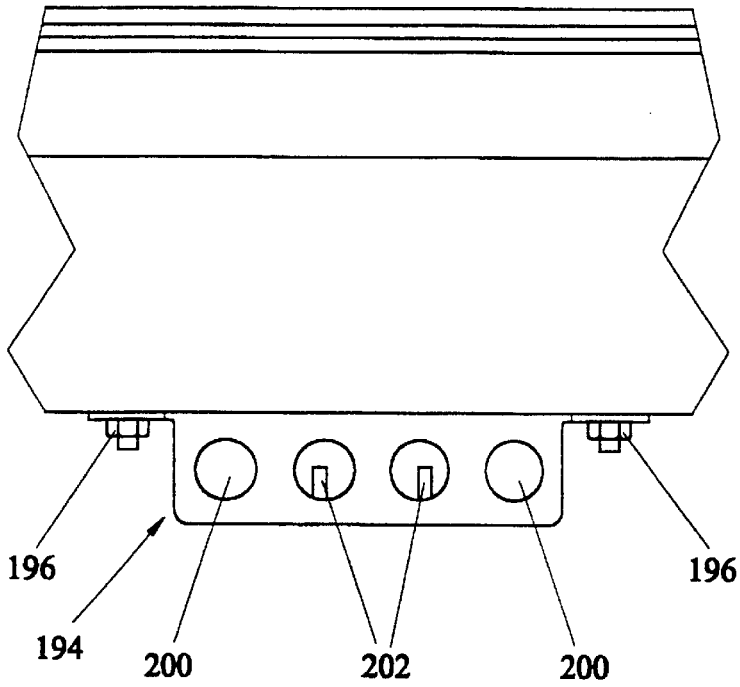
FIG. 21: Shows a side elevational view of the assembly shown in FIG. 20.
Figure 22:
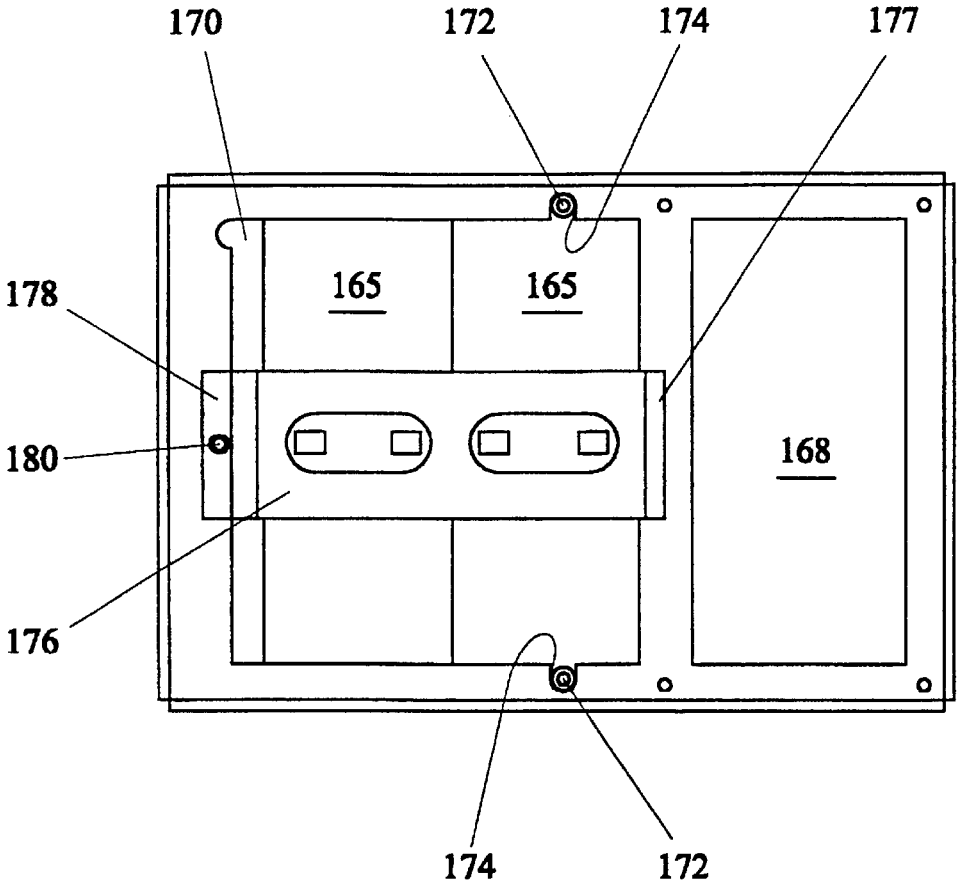
FIG. 22: Shows a view along the line D—D in FIG. 2.

Referring now to FIGS. 20 and 21, terminal box 194 is provided which, as with a number of the components described above, is conveniently mounted on the underside of rail 30, through the fixing channel 38. To this end mounting studs 196, projecting from fixing plate 198 slidable in the channel 38, are passed through the base of the terminal box and nuts applied to fix the box 194 in position. A plurality of knock-out apertures 200 are provided in the walls of the terminal box to allow the cables 195 (FIG. 4) which control the various different functions of the stairlift, to pass into the box and be engaged with terminal blocks 202 located inside the box. As is evident form FIG. 4, cables needing to run the length of the rail can be located within the channel 38.

Where cables pass through knock-outs 200, cable glands (not shown) are provided to prevent cables being abraded by the edges of apertures 200.

It will thus be appreciated that the present invention, at least in respect of the preferred embodiment described herein, provides a compact form of stairlift apparatus which incorporates a number of innovations to ensure the provision of a strong, efficient and safe form of stairlift from a reduced number of working parts.

What is claimed is:

1. A stairlift apparatus, comprising:

a rail means consisting of only a single rail, said single rail having a substantially uniform, non-circular, tubular cross-section;

a plurality of rolling surfaces extending longitudinally from said single rail, said plurality of rolling surfaces being arranged about said cross-section of said single rail;

a drive surface included on one of said plurality of rolling surfaces;

a seat section; and, a carriage mounted for movement along said single rail, said carriage being arranged for locating said seat section above said single rail and having a plurality of rollers for engaging said plurality of rolling surfaces for supporting said carriage on said single rail and preventing said carriage from rotating about said single rail, said carriage further including a drive wheel drivingly engaging said drive surface, said plurality of rollers being mounted for rotating about an axis parallel to one rolling surface of said plurality of rolling surfaces which a given roller of said plurality of rollers engages, and said drive wheel being mounted for rotating about an axis parallel to a plane of a given rolling surface of said plurality of rolling surfaces on which said drive surface is included.

2. The stairlift apparatus according to claim 1, further comprising means for minimizing tilting and skewing movement of said carriage relative to said single rail.

3. The stairlift apparatus according to claim 1, wherein said single rail includes at least three rolling surfaces about an outer surface of said single rail, with one roller of said plurality of rollers contacting each of said three rolling surfaces.

4. The stairlift apparatus according to claim 1, wherein said single rail includes four rolling surfaces about said cross-section of said single rail extending longitudinally of said single rail, a longitudinally spaced pair of rollers of said plurality of rollers being provided for each of said four rolling surfaces.

5. The stairlift apparatus according to claim 4, where in said four rolling surfaces are provided as a pair of upper rolling surfaces and a pair of lower rolling surfaces.

6. The stairlift apparatus according to claim 5, wherein said single rail further includes means for mounting said single rail between said lower pair of rolling surfaces.

7. The stairlift apparatus according to claim 5, wherein said rolling surfaces of said pair of upper rolling surfaces and said pair of lower rolling surfaces are juxtaposed surfaces of different pairs of said pair of upper rolling surfaces and said pair of lower rolling surfaces.

8. The stairlift apparatus according to claim 7, wherein said juxtaposed surfaces of different pairs of said pair of upper rolling surfaces and said pair of lower rolling surfaces are perpendicular to one another.

9. The stairlift apparatus according to claim 5, further comprising drive transfer means on, or adjacent to, one pair of said pair of upper rolling surfaces.

10. The stairlift apparatus according to claim 9, wherein said drive transfer means comprises a gear rack.

11. The stairlift apparatus according to claim 10, further comprising rack cover means for at least partially overlie said gear rack and a screen from sight when said single rail is viewed from above.

12. The stairlift apparatus according to claim 11, wherein said rack cover means comprises a mounding or extrusion fixed above said gear rack and extending longitudinally of said single rail.

13. The stairlift apparatus according to claim 1, further comprising:

drive means mounted within said carriage, said drive means having a drive shaft rotatable about a drive axis, with said drive wheel being mounted for rotation on said drive shaft, said drive means not overlying said single rail when viewed in a direction perpendicular to said drive axis.

14. The stairlift apparatus according to claim 13, wherein said drive surface comprises a rack and said drive wheel comprises a pinion engagable with said rack.

15. The stairlift apparatus according to claim 1, wherein all rollers of said plurality of rollers are identical.

16. The stairlift apparatus according to claim 1, wherein each roller of said plurality of rollers is only loaded substantially perpendicular to its respective axis of rotation.

17. The stairlift apparatus to according to claim 1, wherein said carriage has a pair of spaced side plates extending downwardly to at least partially overlie opposite side parts of said single rail, said rollers extending from said pair of spaced side plates.

18. The stairlift apparatus according to claim 17, wherein said pair of spaced side plates comprise outer surface parts of said carriage.

19. The stairlift apparatus according to claim 17, wherein said pair of spaced side plates include bracing means on inner surfaces thereof, said plurality of rollers being mounted on said bracing means.

20. The stairlift apparatus according to claim 19, wherein said pair of spaced side plates and said bracing means are press formed from sheet metal and subsequently welded together.

21. The stairlift apparatus according to claim 1, wherein said plurality of rollers are provided in cooperating pairs wherein some of said plurality of rollers of each pair of rollers rotate about fixed axes while axes of remaining rollers of said plurality of rollers in each said pair of rollers are displaceable in directions perpendicular to said axes.

22. The stairlift apparatus according to claim 1, wherein said drive surface is arranged at substantially 45° relative to a rail mounting plane.

23. The stairlift apparatus according to claim 1, further comprising joining members and means for receiving and locating said joining members, said joining members being operable for joining sections of rail of said single rail together in an end-abutting register.

24. The stairlift apparatus according to claim 23, wherein said means for receiving and locating include a plurality of joining channels formed on an inner surface of said single rail, said plurality of joining channels being capable of receiving joining members formed as pins.

25. The stairlift apparatus according to claim 24, wherein said plurality of rolling surfaces are provided as a lower pair of rolling surfaces and an upper pair of rolling surfaces each rolling surface of said of upper pair of rolling surfaces being juxtaposed to a surface of said slower pair of rolling surfaces, but having an apex therebetween and with a joining channel formed at, or adjacent to, an inner surface of each said apex.

26. The stairlift apparatus according to claim 25, each joining channel of said plurality of joiniing channels is substantially cylindrical for receiving and joining pins of circular section via an interference fit.

27. The stairlift apparatus according to claim 26, wherein said plurality of joining channels are positioned for receiving fixing screws used in a mounting of end caps and trailing cable tensioning means.

28. The stairlift apparatus according to claim 27, wherein said single rail comprises an aluminum extrusion.

* * * * *